US005217123A

United States Patent [19]

Riley et al.

[11] Patent Number: 5,217,123

[45] Date of Patent: Jun. 8, 1993

[54] RACK FOR HANGING A DISHCLOTH ON THE INSIDE WALL OF A KITCHEN SINK

[76] Inventors: Marion A. Riley; Robert Hesdorfer, both of 12667 Paulette Ave., Pine, Colo. 80470

[21] Appl. No.: 840,117

[22] Filed: Feb. 24, 1992

[51] Int. Cl.[5] ..... A47F 5/00

[52] U.S. Cl. ..... 211/105.1; 211/87; 248/206.3

[58] Field of Search ..... 211/106, 87, 105.1, 211/123; 248/206.3

[56] References Cited

U.S. PATENT DOCUMENTS 1,409,056 3/1922 Michaels ..... 211/123

1,799,558 4/1931 Howard ..... 211/123 X 2,315,566 4/1943 Watral et al. ..... 211/123

2,931,514 4/1960 Hughes ..... 211/123 X

FOREIGN PATENT DOCUMENTS 212802 1/1961 Austria ..... 248/206.3

454446 2/1949 Canada ..... 248/206.3

*Primary Examiner*—Robert W. Gibson, Jr.

[57] ABSTRACT

A rack designed for attachment to the inside wall of a kitchen sink. A rod is connected to two suction cups within a width that will accommodate either a double or single kitchen sink. It provides a resting place for a dishcloth to dry while being virtually out of sight.

3 Claims, 3 Drawing Sheets

RACK FOR HANGING A DISHCLOTH ON THE INSIDE WALL OF A KITCHEN SINK

BACKGROUND

Field of Invention

This invention relates to a rack in the kitchen sink specifically for hanging a dishcloth in such a way that it is hidden from direct view.

2. Description of Prior Art

A patent search resulted in discovering no prior art.

The only available rack attached to suction cups would not be at all suitable for use in the kitchen sink for several reasons:

1. It is not designed for various sink widths and is too wide (30.48 cm) to work in most double-tub sinks.

2. The rack would extend too far into the sink and would conflict with normal sink use.

3. The white suction cups and the semi-square (in cross-section) rod and its configuration make it clumsy in appearance and unattractive for kitchen use.

4. According to its packaging, it is designed for use as a towel rack.

The problem of an unsightly dishcloth draped over the kitchen sink in full view is solved by a rack on the inside wall of the sink.

OBJECTS AND ADVANTAGES

In addition to the primary purpose of the rack, as stated above, several other objects and advantages of the present invention are:

(a) to provide a convenient resting place that allows the damp dishrag to dry with air freely circulating around it.

(b) to provide simple installation in just seconds without need of tools.

(c) to provide a convenient article for daily use that can be manufactured easily and inexpensively in one or more of the proposed design configurations described later.

(d) to provide a lightweight, compact, durable rack that will be easy to package and ship.

(e) to provide a rack that can be packaged and displayed simply and effectively on a card to be hung on a display rod or placed in a bin.

(f) to provide a solution to the universal dishrag problem in a way that can be quickly understood by the potential buyer.

(g) to provide a useful article for kitchens in homes, apartments, condominiums, offices, motor homes, pleasure boats, shower stalls, bathtubs, laundries and wet bars.

(h) to provide a sleek, simple rack that can be used on any smooth surface such as tile, glass, porcelain, laminate or metal in any area suitable for hanging a lightweight article such as a small towel, washcloth, pantyhose or nylon stockings.

Additional objects and advantages will become apparent from a consideration of the ensuing description and drawings.

DRAWING FIGURES

In the drawings, closely related figures have the same number but different alphabetic suffixes.

FIG. 1 is an exploded perspective view of the basic version of our dishrag rack invention.

FIG. 2 shows a perspective view of parts 8L, 8R and 10 assembled to form the finished dishrag rack.

FIG. 3 is an actual size top and side view of parts 8L and 8R, illustrating the location, angle and length of the receptacle hole.

FIG. 4 shows a half-size plan view of part 10 alone, and plan and top views of parts 8L, 8R and 10 assembled.

FIG. 5 shows a perspective view of the dishcloth rack in use, installed on the front inside surface of a sink.

FIG. 6 shows a plan view of the rack installed in a double sink 33.65 cm in width.

REFERENCE NUMERALS IN DRAWINGS

8 clear plastic suction cups
10 stainless steel rod

To assemble the dishrag rack, one end of the rod, part 10, is inserted into the receptacle hole in part 8L with a twisting motion, to drive the rod end all the way into the receptacle hole. The same procedure is used to fit the other end of part 10 into the receptacle of part 8R. The pieces are held firmly together by a force fit, since the receptacles, 0.238 cm in diameter, stretch slightly to accept and firmly hold the 0.31 cm diameter rod, 10.

Figure 5:
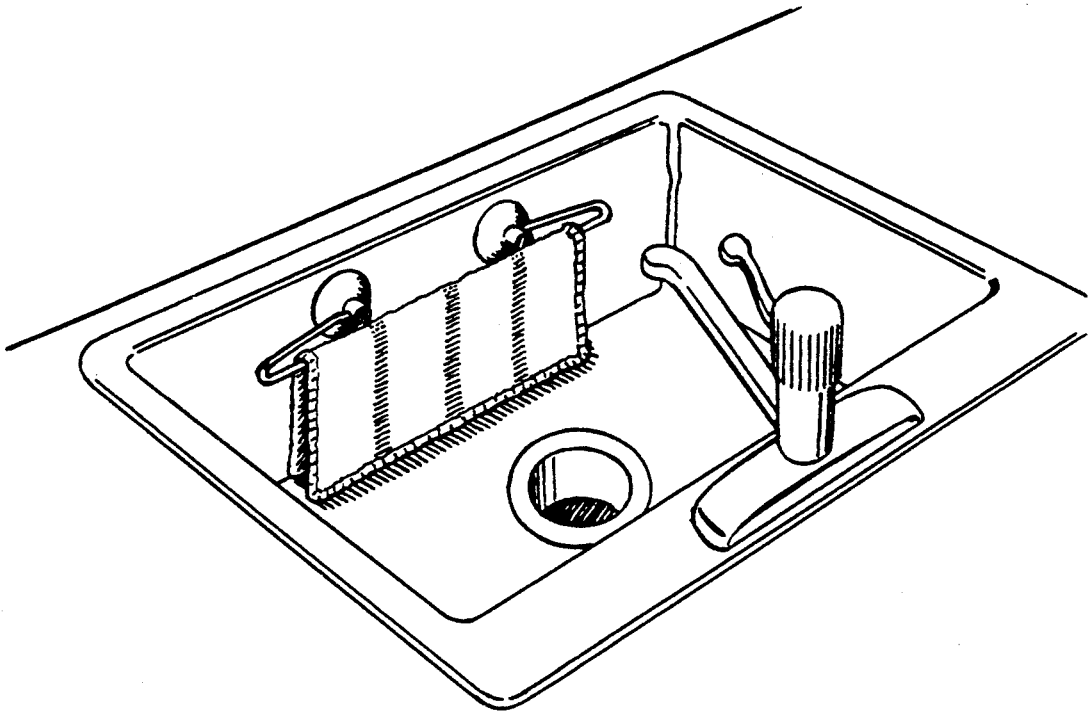

FIG. 5 shows a perspective view of the dishcloth rack in use, installed on the front inside surface of a sink, adhered by suction cups 8L and 8R, with a dishrag folded over rod, 10.

Figure 6:
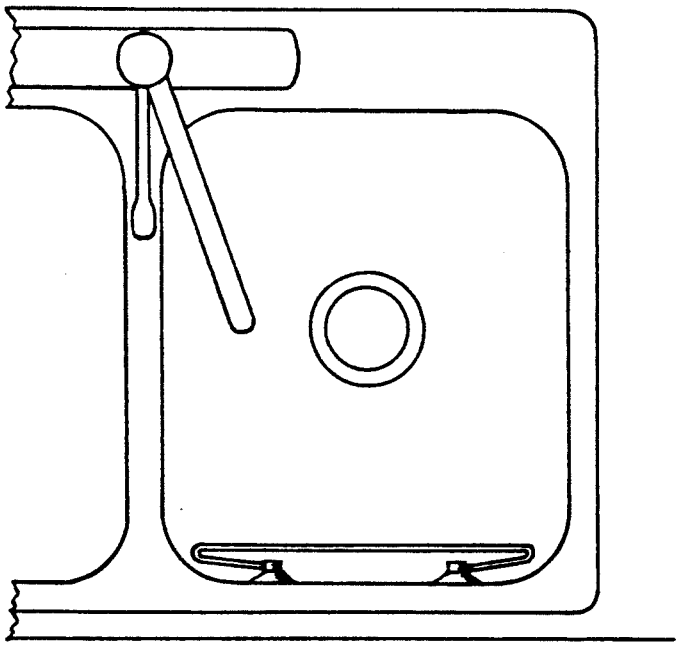

FIG. 6 shows a plan view of the rack installed in a double sink 33.65 cm in width, with a corner radius of six centimeters. Note that the suction cups 8L and 8R are spaced to fit within the 21.6 cm wide flat surface of the sink wall, yet the rack provides 28.57 cm of length on which to hang a dishrag.

DESCRIPTION OF INVENTION—FIGS. 1, 3, 4 AND 6.

Figure 1:
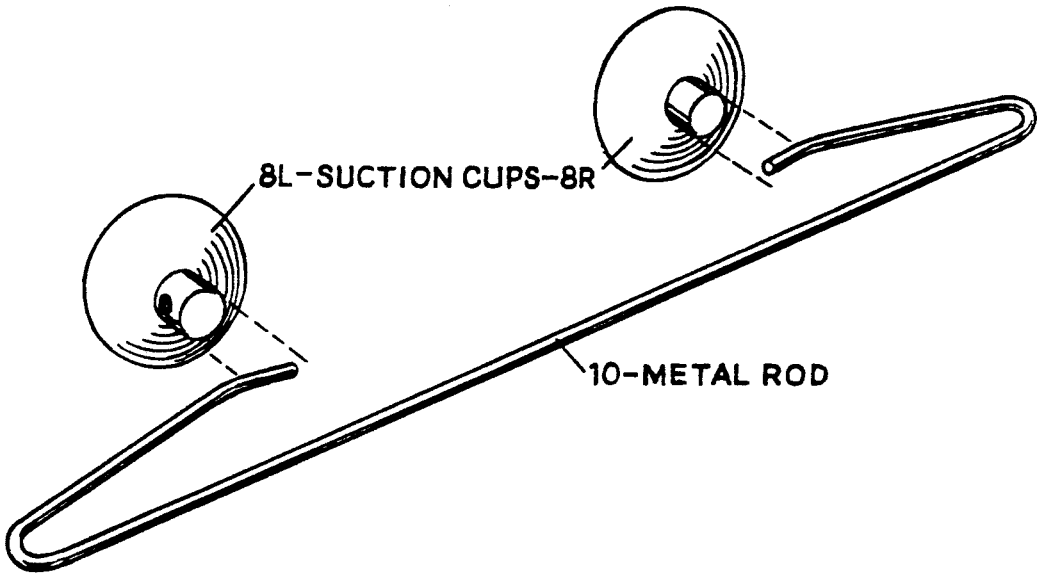
FIG. 1 is an exploded perspective view of the basic version of our dishrag rack invention. Parts 8L and 8R are clear plastic suction cups. A receptacle hole is molded or drilled into the neck of both suction cups, 8L and 8R, to receive part 10. Details of parts 8L and 8R and the receptacle hole are shown in FIG. 3. Part 10 is a 44.45 cm length of 0.31 cm diameter stainless steel rod, bent to the configuration illustrated in FIG. 1 and shown in scale elevation detail in FIG. 4.
Figure 2:
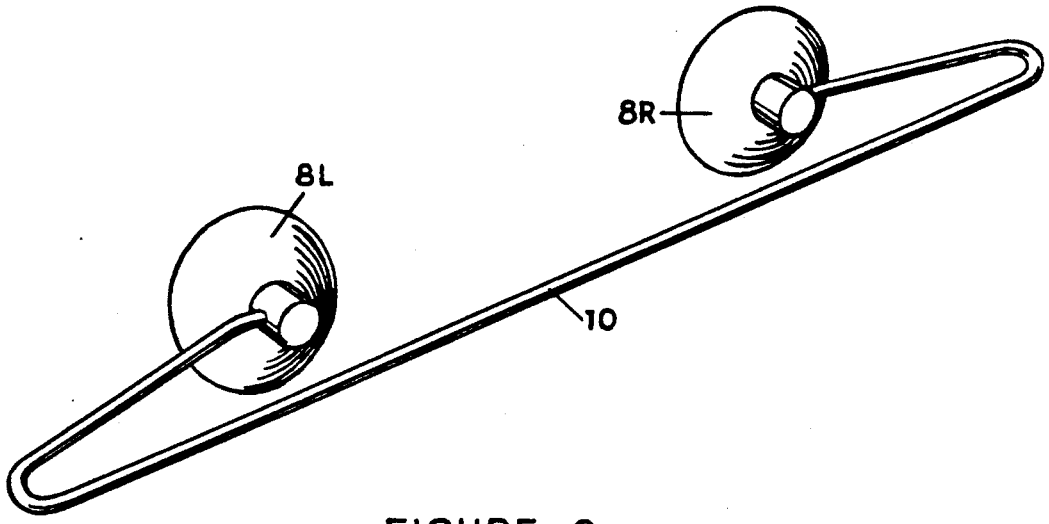
FIG. 2 shows a perspective view of parts 8L, 8R and 10 assembled to form the finished dishrag rack.
Figure 4:
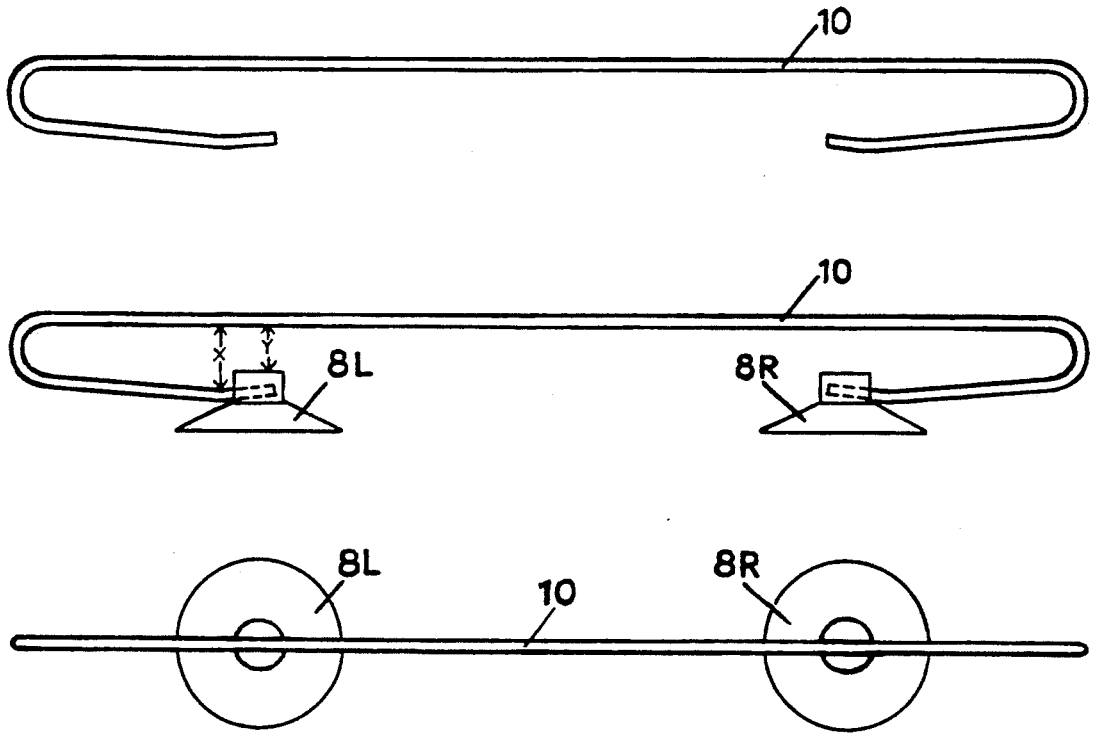
FIG. 4 shows a half-size plan view of part 10 alone, and plan and top views of parts 8L, 8R and 10 assembled. Overall width of the assembled rack is 29.2 cm. Overall height, or depth, is 3.2 cm. Inside radius of the bend at each end of rod, part 10, is 1.37 cm. Length of the ten-degree bend where rod, 10, enters suction cups, 8L and 8R is 1.3 cm. Overall height from base of suction cups to top edge of rod is 3.175 cm. Distance X is 1.90 cm. Distance Y is 1.60 cm.

FIG. 1 shows a perspective view of a basic version of our dishrag rack. It consists of part 10, a stainless steel rod, and parts 8L and 8R, suction cups. Rod, 10, is bent to the configuration illustrated in FIG. 6 in order to fit inside a double sink. Parts 8L and 8R are clear plastic suction cups with holes sized to fit the diameter of part 10. The holes are of a 0.238 cm diameter and are drilled just above the point where the neck joins the cup section of parts 6L and 6R. Rod, 10, is 44.45 cm in length and 0.31 cm in diameter bent at each end to provide a 29.2 cm width in the assembled rack. In FIG. 4 the distance of X is 1.90 cm, the distance of Y is 1.587 cm.

Figure 3:
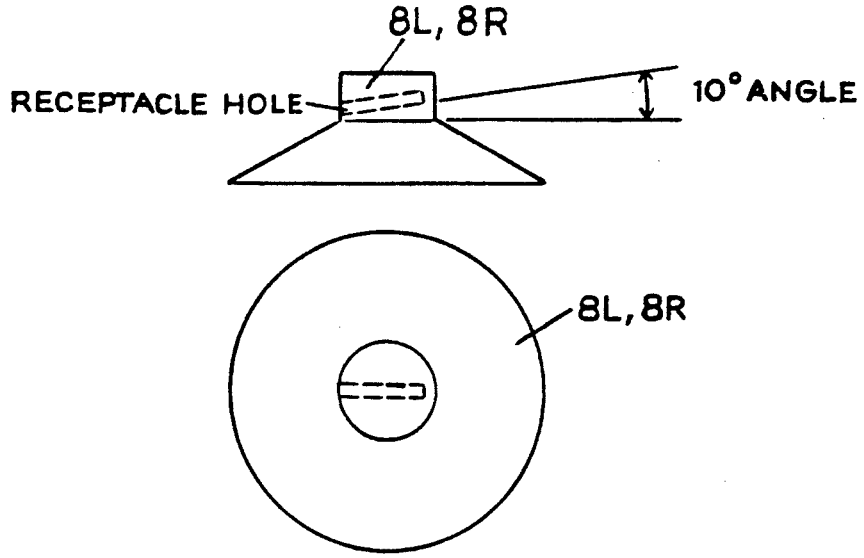
FIG. 3 is an actual size top and side view of suction cups 8L and 8R, illustrating the location, angle and length of the receptacle hole, which is molded or drilled into the neck of those parts. Part 8R, not shown, is identical to part 8L. Parts 8L and 8R are approximately 1.4 cm in overall height. The neck of each is 1.3 cm in diameter and 0.8 cm in height. The hole would be drilled/molded with a 0.238 cm diameter to a length of 1.11 cm, with the hole beginning just above the point where the neck joins the cup, or base, section of parts 8L and 8R. The hole would be drilled/molded at an upward angle of ten degrees, as shown in the drawing. Parts 8L and 8R might be purchased from already existing inventory, in which case the receptacle hole would be drilled. If used in sufficiently large quantities, parts 8L and 8R could be custom-manufactured with the receptacle hole molded integrally into the suction cups.

FIG. 3 illustrates the location, angle and length of the receptacle hole which is drilled into the neck of parts 8L and 8R. Parts 8L and 8R are approximately 4.4 cm in diameter at their base and 1.4 cm in overall height. The neck of each is 1.3 cm in diameter and 0.8 cm in height.

The rack is assembled by inserting an end of part 10 into the receptacle hole in part 8L using a twisting motion to drive the rod end completely into the hole. The same procedure is used to fit the other end of part 10 into part 8R.

From the description above, a number of advantages of our rack become evident:

(a) its installation is simple and requires only a dab of cooking oil spread on the surfaces of parts 8L and 8R, to better adhere the suction cups to the sink surface.

(b) it is lightweight, compact and durable.

(c) it can be used on any smooth surface such as tile, porcelain, glass, laminate or metal.

(d) it can be packaged and displayed simply and effectively.

(e) its use is readily understood by the consumer at point-of-purchase.

OPERATION—FIGS. 5 AND 6

The manner of using the rack is demonstrated in FIG. 5. A dishrag is hung on it with the advantage of being virtually out of view. Yet the position of the dishrag on the rack allows for air flow necessary for drying the dishrag. As demonstrated in FIG. 6, the configuration of the assembled product allows the rack to fit inside a double kitchen sink as narrow as 33 cm, or into a single sink of greater width. In addition to use in the kitchen sink, it can be attached to a smooth, hard surface in any area that requires the drying of a lightweight article.

It can also be used:

in bedrooms for hanging scarves, ties and belts.

in mobile homes for small items that need to be hung.

in utility rooms for rags and some cleaning articles.

in motel rooms for use by travelers.

In summary, it answers a need found by people of all ages in a number of locations.

CONCLUSION, RAMIFICATIONS AND SCOPE

Thus the reader will see that the rack of the invention is to be used in the inside of a sink. Its specific purpose is for hanging a dishcloth on a rack that is hidden from direct view.

Some advantages of the invention:

it answers a universal need experienced by men, women and children.

it can be used by people of all ages.

it can be installed in seconds and used immediately.

it allows air drying in an inconspicuous place, thus reducing the need for mechanical, polluting dryers.

it prevents mildewy odors, especially in humid climates.

Besides its specific purpose it can be used in any area that requires the drying of a lightweight, wet article. Examples are washcloths, cleaning rags, small towels and nylon articles. Accordingly, the rack could be used in shower stalls, bathtubs, laundry tubs, utility rooms, wet bars, medical laboratories and on automobile windows. Since it can be hung on any hard, nonporous surface, its uses are countless.

The examples listed above should not be construed as limiting the scope of the invention. Its scope should be determined by the appended claim and its legal equivalents.

We claim:

1. A rack device for holding a towel inside a sink member having vertically extending inside surfaces and comprising:

a support rod means made of one integral continuous piece of material having a straight elongated horizontal central rod portion for supporting a towel and a pair of opposite reversely bent horizontal end portions extending toward one another in generally parallel spaced relationship to said central rod portion and being spaced from one another a distance substantially less than the length of said central rod portion; and a suction cup means fixedly mounted on each of said end portions for engagement with an inside surface of a sink for holding said central portion in inwardly spaced relationship to the inside surface of the sink.

2. The invention as defined in claim 1 and wherein each of said end portions comprising:

a curved connecting section;

a straight rearwardly outwardly inclined intermediate horizontal section; and a straight horizontal end section; and said suction cup means being means mounted on each of said straight horizontal end sections and spaced laterally inwardly of said curved connecting section and spaced laterally rearwardly of said central rod portion.

3. The invention as defined in claim 2 and wherein each of said suction cup means comprising:

a suction cup portion having a vertical suction surface;

a central hub portion extending laterally horizontally away from said hub portion with a central longitudinal axis which is coplanar with said central rod portion;

a horizontal laterally extending mounting hole in said hub portion; and said straight end section being mounted in said mounting hole in coplanar relationship with said central rod portion.

* * * * *